US008342086B2

(12) United States Patent
Resch et al.

(10) Patent No.: US 8,342,086 B2
(45) Date of Patent: Jan. 1, 2013

(54) DRIVE DEVICE FOR A BENDING PRESS

(75) Inventors: Markus Resch, Hofstetten-Gruenau (AT); Rudolf Scheidl, Erlauf (AT); Peter Ladner, Leonding (AT); Karl Ladner, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 324 days.

(21) Appl. No.: 12/733,623

(22) PCT Filed: Sep. 12, 2008

(86) PCT No.: PCT/AT2008/000325

§ 371 (c)(1),
(2), (4) Date: Mar. 23, 2010

(87) PCT Pub. No.: WO2009/033199

PCT Pub. Date: Mar. 19, 2009

(65) Prior Publication Data

US 2010/0212521 A1 Aug. 26, 2010

(30) Foreign Application Priority Data

Sep. 12, 2007 (AT) ..... A 1428/2007

(51) Int. Cl.
*B30B 1/32* (2006.01)

(52) U.S. Cl. ..... 100/269.14; 100/269.13

(58) Field of Classification Search ..... 100/269.01, 100/270, 269.05, 269.08, 269.09, 269.11, 100/269.13, 269.14; 72/453.02, 453.06, 72/453.08, 453.09

See application file for complete search history.

(56) References Cited

U.S. PATENT DOCUMENTS 3,759,144 A 9/1973 Ikeda (Continued)

FOREIGN PATENT DOCUMENTS

AT 008 633 10/2006

(Continued)

OTHER PUBLICATIONS

International Search Report.

*Primary Examiner* — Jimmy T Nguyen
(74) *Attorney, Agent, or Firm* — Collard & Roe, P.C.

(57) ABSTRACT

The invention relates to a drive device (1) for a bending press, in particular a folding press (2), comprising a press frame (3), a press table (9) and a press beam (11) that can be adjusted relative to the press table (9) via a hydraulic system (18) comprising a hydraulic pump (47), controlled drive motor (45), switch and control means and pressure lines and at least one pressure cylinder (12) which can be supplied with at least one pressure medium. The hydraulic system (18) forms a closed system together with a ring line (44) comprising the hydraulic pump (47), control valves (39, 41, 58, 84, 86, 87, 88, 89) and a pressure store (57). The ring line comprises a first line section (51) between a pressure chamber (23) of the pressure cylinder (12) and the hydraulic pump (47) and a second line section (53) between an additional pressure chamber (22) of the pressure cylinder (12) and the hydraulic pump (47). The pressure store (57) can optionally be in fluid connection via at least one of the control valves (58, 84, 86) with the first line section (51) or the second line section (53) to take up or release a storage volume of the pressure medium.

19 Claims, 11 Drawing Sheets

U.S. PATENT DOCUMENTS

| | | | | |
|---|---|---|---|---|
| 6,851,355 | B2 * | 2/2005 | Harada et al. | 100/35 |
| 6,964,225 | B2 * | 11/2005 | Gubler et al. | 100/214 |
| 2005/0193798 | A1 * | 9/2005 | Kanno | 72/453.02 |

FOREIGN PATENT DOCUMENTS

| | | | |
|---|---|---|---|
| DE | 626 344 | | 2/1936 |
| DE | 1 027 951 | | 4/1958 |
| DE | 21 40 183 | | 2/1972 |
| EP | 0 967 028 | | 12/1999 |
| GB | 538 247 | | 7/1941 |
| GB | 749 571 | | 5/1956 |
| JP | 06039599 | A * | 2/1994 |
| JP | 2000-107814 | | 4/2000 |
| JP | 2002-147404 | | 5/2002 |
| WO | WO 2006/101156 | | 9/2006 |

* cited by examiner

DRIVE DEVICE FOR A BENDING PRESS

CROSS REFERENCE TO RELATED APPLICATIONS

This application is the National Stage of PCT/AT2008/000325 filed on Sep. 12, 2008 which claims priority under 35 U.S.C. §119 of Austrian Application No. A 1428/2007 filed on Sep. 12, 2007. The international application under PCT article 21(2) was not published in English.

BACKGROUND OF THE INVENTION

1. Field of the Invention

The invention relates to a drive device, as described in the preamble of claim 1.

2. The Prior Art

From document WO 2006/101156 A1 a hydraulic drive device for a folding press and a method for operating the latter are known, according to which with an open hydraulic system for supplying operating cylinders a hydraulic pump is driven by a speed-controlled motor. The speed can be varied according to the different requirements for movement operations, such as rapid traverse, press traverse, emergency stop, return stroke, from standstill to maximum speed.

From document JP 2002-147404 A a drive device for a bending press is known comprising a press frame and with a fixed press beam and a press beam adjustable relative to the latter, wherein the drive device consists of a hydraulic system with a hydraulic pump and a ring line with control valves for a switchable flow circuit for a pressure medium for alternately charging two pressure chambers of at least one pressure cylinder for the adjustment of the press beam. The hydraulic system is an open system supplied with pressure medium from a tank, which excludes a pressure store, as the differential volume of medium required for the different filling volumes of the pressure chambers of the hydraulic cylinder is conveyed respectively into or out of the tank. This requires a suitably high overall volume and conveying volume of the pressure medium for the alternate charging of the hydraulic cylinder.

From document DE 1 027 951 B a hydraulic-rapid control is known with devices for avoiding control shocks for hydraulic presses, hydraulically operated machine tools or the like. The rapid control comprises in addition to a main valve an additional control valve, which by means of a connection line produces the connection between a pressure source, e.g. a pump, an accumulator, a press cylinder and the main control valve. Furthermore, it comprises a bypass line, which leads directly from the pressure source to the main control valve, wherein the latter has a smaller cross section than the connection line running via the additional control valve, and in said bypass line if necessary also a throttle valve can be provided. Thus pressure shocks caused by the control processes are counteracted by the corresponding cross sectional selection of the connection line as well as the regulating possibility of the throttle valve and as far as possible pressure equalization is achieved.

From a further document, DE 21 40 183 A1, a hydraulic drive device is known with an open design, with a tank, pump and feed line for charging a pressure chamber of an operating cylinder with a pressure medium. A bypass line of the pressure medium from the additional pressure chamber can be supplied via a switch valve optionally to the feed line or returned as a function of the determined pressure level in the feed line or the pressure chamber via an outflow line into the tank. By mixing the outflowing pressure medium into the feed line with a predefined output of the pump there is an increase in the displacement speed of the press beam before the actual pressing operation, i.e. a rapid approach and thereby a shortened cycle time.

From document EP 0 967 028 A1 a hydraulic press is known with a hydraulic operating cylinder acting on both sides with active faces of varying size on both sides of a piston. The hydraulic drive device comprises a container for the pressure medium, which by means of an electric motor driven pump is fed into in a conveying circuit and via control valves to the operating cylinder, optionally to the pressure chambers separated by the piston for the movement of a press beam connected in motion to the piston or a piston rod for making an adjustment for a press stroke and a return stroke. To reduce the operating cycle between lines for the alternate charging of the pressure chambers of the operating cylinder an additional suction line with an additional suction valve is provided for a rapid equalisation of the volume flows of the pressure chambers with different capacities.

From a further document, AT 008 633 U1, a hydraulic drive unit is known for a press, e.g. a die bending press, for activating a press beam by means of a double-acting hydraulic cylinder with different active surfaces. The hydraulic drive unit comprises a container for a pressure medium, an electric motor driven pump and supply lines and control valves and a flow-connected, chargeable pressure store, by means of which for compensating the inherent mass of the press beam a counteracting force is provided by the operating cylinder.

Conventional driving techniques in presses of higher force categories use a hydraulic load-sensing principle for the operating process and a hydraulically controlled drop of the pressure beam in rapid traverse downwards. As in load-sensing operation a control reserve of the pressure loss is required and the movement is also controlled during the rapid-up or rapid-down traverse via a resistance control, losses are caused as defined by the principle. The resulting oil-warming has to be reduced in many cases by oil coolers. A further disadvantage is that the electric drive motor and the connected hydraulic constant flow pump run during the entire operating period, which results in losses and unnecessary noise. Such a driving configuration comprises one hydraulic supply unit per machine, which in addition to the pump and motor also comprises tank connecting lines and various auxiliary devices and prevents a strictly modular construction, in which each axis is completely separate and compact. Numerous hydraulic connections have to be produced in the assembly process of the press. The latter may lead to leakages caused by permeability, breaks in the tubing or during the replacement of hydraulic components.

Furthermore, today electric-hydraulic hybrid drives are known, the basic idea of which is to connect a hydraulic constant flow pump with a variable-speed electric motor, in order to control the speed electrically in this way and to use the connected hydraulic circuit with a hydraulic cylinder at its end on the one hand for simple force translation and on the other hand as a change-speed gearbox for rapid operation shifting. An open hydraulic system is used for this, which, in addition to the actual operating cylinder, designed as a single-thread differential cylinder, uses an additional plunger cylinder. Its hydraulically active surface is equal to the ring surface of the differential cylinder. The cylinder chambers assigned to both these areas are switched in rapid traverse, such that the action of a through rod cylinder is adjusted which is moved by the pump. The piston-side chamber suctions in rapid traverse from the tank. In working operation the pump acts on the piston side of the differential cylinder, the annular side lies on a hydraulic storage unit for holding.

SUMMARY OF THE INVENTION

The objective of the invention is to create a drive device for a bending press, which is highly effective and thus can be operated in an energy-saving manner and allows a compact, modular construction.

Said objective of the invention is achieved by means of a drive device for a bending press as described herein. The surprising advantage in this case is that by means of a closed hydraulic system with a ring line and medium store the volume of pressure medium required for operation and thereby the power requirement for supplying the drive components with medium can be kept low. Furthermore, also a stop/go operation is made possible, by means of which environmental pollution is kept low with a reduction in noise emissions.

The invention is explained in more detail in the following with reference to the exemplary embodiments shown in the Figures.

With an advantageous development according to the invention, the pressure store can be designed for a small storage volume of a differential volume of the pressure chambers of the pressure cylinder and for example a size of 0.75 l is sufficient and with a required storage pressure of about 3 bar to 5 bar an expensive storage protection lock and a storage check can be omitted and even with a small conveying volume of pressure medium and thus at a low pump output very high rapid traverse speeds are achieved.

In another advantageous embodiment small flow losses are achieved at a higher conveying output and the volume flow mostly required for a rapid traverse downwards is guided directly between the pressure chambers of the pressure cylinder, and by means of the cartridge valve provided in the bypass line which is set up for high volume flow cavitation is avoided effectively in the pressure cylinder.

Embodiments are also advantageous, by means of which a rapid reaction is achieved for a reversing operation and an appropriately controllable driving and braking action is ensured by the controllable drive of the hydraulic pump.

An embodiment is also possible, by means of which various different storage concepts are achieved.

Lastly, the embodiments are also advantageous, by means of which different machine concepts can be adapted to the application and in this way the range of applications is increased.

DETAILED DESCRIPTION OF THE PREFERRED EMBODIMENTS

Figure 1:
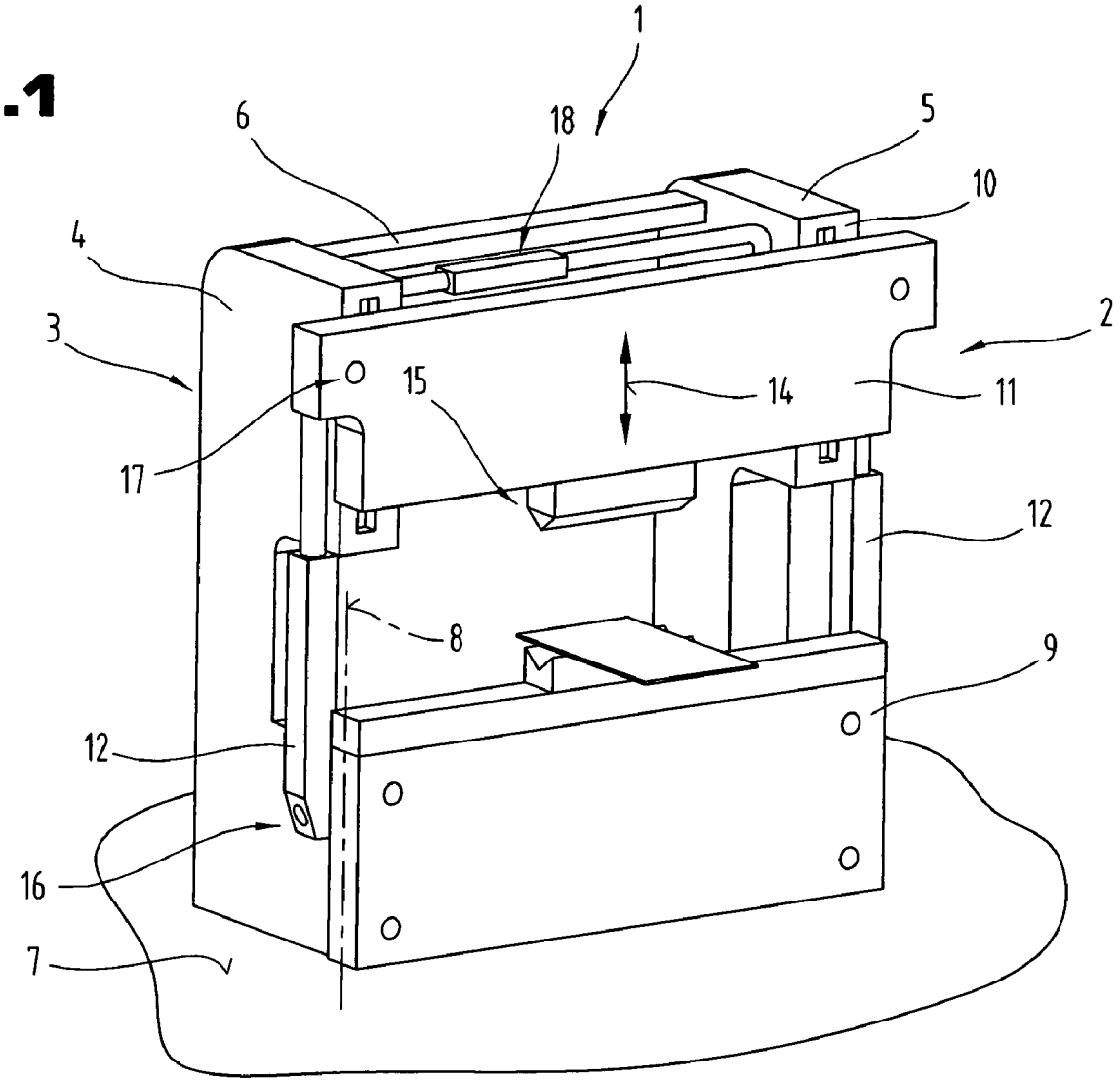
FIG. 1 shows a possible folding press in schematic view, according to the prior art.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIG. 1 shows a folding press 2 operated by means of a hydraulic drive device 1 in a simplified representation with a press frame 3, consisting substantially of side mounts 4, 5, a cross connection 6 and a fixed board-like press table 9 aligned in a plane 8 that is vertical to a contact surface 7.

In a direction vertical to the contact surface 7 in linear guides 10 on the side mounts 4, 5 an upper press beam 11 is guided adjustably, which in the shown exemplary embodiment consists of two pressure cylinders 12 as driving means 13 of the hydraulic drive device 1 according to—double arrow 14—between an upper end position and a lower controllable end position, for applying a shaping force onto a workpiece, inserted between bending tools 15 of the press table 9 and press beam 11 for a shaping procedure, e.g. a metal board, blank moulding etc.

The pressure cylinder 12 is arranged in the shown exemplary embodiment for the application of tensile force during a shaping operation on the workpiece of the press beam 11 and the application of pressing force during a reversal of movement or a stop or holding of the press beam 11, whereby force is transmitted via a housing bearing 16 and a rod bearing 17.

Figure 2:
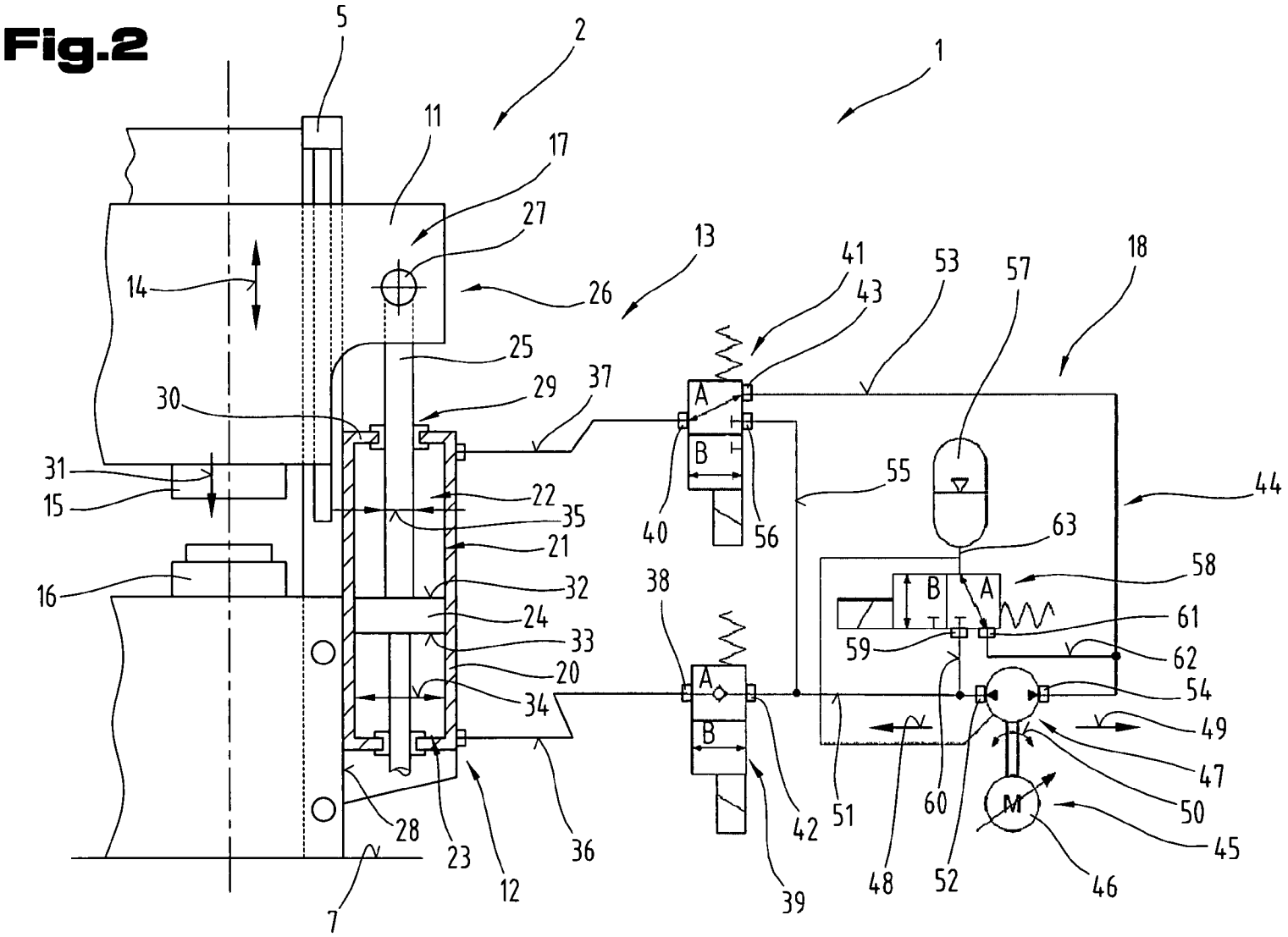
FIG. 2 shows a simplified hydraulic drive device according to the invention for the folding press.

FIG. 2 shows in detail the hydraulic drive device for the press beam 11 by way of the example of a pressure cylinder 12 and a possible hydraulic system 18 in a simplified embodiment.

To simplify the representation and description of the hydraulic drive device 1, the latter is explained in its design and action by the example of only one of several, preferably two, pressure cylinders 12 which are arranged symmetrically to a transverse middle plane of the press 1 and operated by means of the shown hydraulic system 18.

For a reversible application of force the pressure cylinder 12 is designed as a so-called double-acting differential cylinder 19, with a cylinder housing 20 and a piston 24 that is adjustable therein by charging with a pressure medium, and divides a cylinder chamber 21 into pressure chambers 22, 23.

The piston 24 is secured onto a piston rod 25 projecting on one side out of the cylinder housing 20 which is drive-connected in a projecting end section 26 to the press beam 11, e.g. by means of a bolt 27, which allows tolerance of an angular deviation.

In a bearing arrangement formed on the cylinder housing 20 the pressure cylinder 12 according to the shown exemplary embodiment is secured onto a side face 28 of the side mount 5, whereby the piston rod 25 projects out of the cylinder housing 20 in a pressure-tight rod throughput 29 of an end flange 30 facing away from the contact surface 7 and as already described above is drive-connected in the end section 26 to the press beam 11 by means of the bolt 27.

In this arrangement of the pressure cylinder 12 by means of the piston rod 25 the press beam 11 is supported in a position of rest against the action of an inherent mass component—according to arrow 31—, i.e. the piston rod 25 is subjected in this operating state to pressure loading, whereby the pressure loading in addition to the inherent mass component—according to arrow 31—varies with acceleration forces by the movement of the press beam 11—according to double arrow 14—both on braking and with a reversal in movement and this has to be taken into account with regard to the dimensioning of the piston rod 25.

During a shaping process on the workpiece between the bending tools 15, 16 tensile force loading occurs in the piston rod 25 as soon as the necessary shaping force component exceeds the inherent mass component of the press beam 11.

By means of the piston rod 25 moved out on one side of the cylinder chamber 21 different piston active faces 32, 33 face the pressure chambers 22, 23, whereby the rod-side piston active face 32 forms a circular ring face from a circular area with the inner diameter 34 of the cylinder chamber 21 minus a circular area from a piston rod diameter 35 and the piston active face 33 of a circular area opposite on the piston 24 corresponds to the inner diameter 34 of the cylinder chamber 21.

As explained in more detail in the following it is advantageous if the ratio of the piston active faces 32, 33 is greater than 1 up to less than 1.5, which is the same for the different volume flows for charging the pressure chambers 22, 33 from the hydraulic system 18 to perform a working cycle, which comprises the double adjustment path between an upper and lower end position of the press beam.

FIG. 2 also shows the hydraulic system 18 in a simplified embodiment in the form of a hydraulic scheme for controlling the hydraulic cylinder 12, which is a closed and substantially tankless hydraulic system 18.

The pressure cylinder 12 is supplied by the hydraulic system 18 with pressure medium via a pressure line 36 in the piston-side pressure chamber 23 for the opening movement and via a pressure line 37 in the rod-side pressure chamber 22 for the closing movement.

The pressure line 36 connects the pressure chamber 23 with a connection 38 of a control valve 39 and the pressure line 37 connects the pressure chamber 22 with a connection 40 of an additional control valve 41.

Connections 42, 43 of the control valves 39, 41 are flow-connected with a ring line 44 in which a hydraulic pump 47 operated by a speed and rotary direction controllable drive motor 45, in particular an electric motor 46, is arranged, whereby a medium flow can be reversed according to arrows 48, 49 according to a selected direction of rotation according to—double arrow 50—of the drive motor 45 and thus the hydraulic pump 47 between the control valves 39, 41.

The ring line 44 forms a first line section 51 between a first connection 52 of the hydraulic pump 47 and the connection 42 of the control valve 39 and a second line section 53 between a second connection 54 of the hydraulic pump 47 and the connection 43 of the control valve 41, whereby according to the selected direction of rotation of the electric motor 46 and a first or second switching position of the control valves 39, 41 a flow connection is formed between the hydraulic pump 47 and the piston-side pressure chamber 23 or the rod-side pressure chamber 22 of the pressure cylinder 12, or the flow connection between the ring line 44 and the pressure line 36 for the piston-side pressure chamber 23 or between the ring line 44 and the pressure line 37 for the rod-side pressure chamber 22 of the pressure cylinder 12 is interrupted.

A bypass line 55 branches off from the first line section 51, between the hydraulic pump 47 and the control valve 39, which leads to a second connection 56 of the control valve 41.

Furthermore, the ring line 44 is flow-connected with a pressure store 57 via a 3/2-way control valve 58, of which one connection 59 of the control valve 58 is connected via a line 60 to the line section 51 and a further connection 61 of the control valve 58 is connected via a line 62 to the line section 53 and the pressure store 57 is connected to a connection 63 of the control valve 58. Said flow connection of the pressure store unit 57 through the lines 60, 62 in connection with corresponding switching positions of the control valve 58 allows the necessary storage or release of a portion of pressure medium in circulation, whereby short control operations can be performed and the required amount of pressure medium can be kept low in the hydraulic system 18.

The control valves 39, 41, 58 in the shown exemplary embodiment are on-off electric switch valves, preferably piston valves with spring feedback and in the following description of functions the switching positions, which differ according to the operating state, are denoted with cross reference to the view in the figures by letter (A) for the first switching position and (B) for the second switching position.

Firstly, the functional elements according to the hydraulic scheme shown in FIG. 2 are explained in more detail.

In a hydraulic system 18 with a closed flow circuit only a very small volume of pressure medium is displaced—corresponding to the displacement volume of the piston rod 25 or in the case of a piston rod projecting on both sides—as explained in detail in the following—to the differential volume of the two rod elements.

Said displacement volume can be taken up by a very small pressure store 57, or hydraulic store. The required pressure in the pressure store 57—also performing the holding-up function in working operation—in a typical embodiment is 2 bar to 8 bar, preferably 3 bar to 5 bar, and a storage volume of 0.51 to 2.5 l, preferably 0.75 l to 1.0 l is assumed. This forms the basis, according to the guidelines for pressure containers, of managing without a storage safety lock and without a special storage check.

The pressure store 57 performs two functions, a holding up function and tank function (pretensioned tank) for storing and discharging a differential volume of pressure medium as a result of the piston rod 25 entering the pressure chamber 22, or in the case of a piston rod projecting on both side—as explained later in more detail—the differential volume of the two rod elements.

The pressure cylinder 12 is a differential cylinder with a relatively small area extension of the piston rod 25. The piston rod 25 is directed upwards and is drive-connected in a suitable manner with the press beam 11 and supports the latter or draws the latter downwards during a shaping procedure. In this case the operating pressure of the medium acts in the rod-side pressure chamber 22, i.e. on the ring surface of the piston 24. As in the case of workpiece shaping the piston rod 25 is tensioned, there is no risk of bending. Pressure loading is provided only by the proportional inherent weight of the press beam 11 when holding the press beam 11 and in addition by an acceleration component on stopping or during the upwards movement of the press beam.

Only with one pressure cylinder 12, whose lower pressure chamber 23 has a larger effective area than the upper one, is it possible to control the lowering or holding up of the press beam 11 in rapid traverse operation. In rapid-traverse operation, i.e. when both pressure chambers 22; 23 are substantially short-circuited hydraulically, the pressure cylinder 12 corresponds simply to a plunger cylinder with the area of the piston rod 25 as a hydraulic active face. Only an upwardly directed plunger can compensate a downwards directed weight force.

The hydraulic pump 47 is in principle a hydraulic four-quadrant machine. The main pressure loading occurs in working operation, i.e. during the shaping of the workpiece, so that it can be set up as a one-side acting operating pump, which is operated in the other quadrants with much lower pressures.

The speed and the positioning of the press beam 11 is controlled by means of the speed-variable electric motor 46. It operates in both rotational directions in order to be able to move the press beam 11 up and down.

The control valve 39 is a 2/2-way valve and is used for holding up the press beam 11 and for performing an emergency stop, when it is switched into position (A).

The control valve 41 is a 3/2-way valve and is used for switching between rapid traverse and working operation mode. In working operation mode it is in position (A), in rapid traverse mode in position (B).

The control valve 58 is a 3/2-way valve and is also used for switching between rapid-traverse and working operation mode. In working operation mode it is in position (B), in rapid traverse in position (A).

The pressure store 57 is a low pressure store with a relatively small volume. Its pressure in working operation holds the press beam 11 up over the active face of the piston 24 against the weight of the press beam 11. In a rapid traverse movement downwards it holds the volume of oil displaced by the piston rod 25 on entry into the pressure cylinder 12. It functions as a tank in this phase. In the following the functioning of the hydraulic drive device 1 shown in FIG. 2 is described, divided into the phases of a typical folding process, i.e. from an upper position of rest of the press beam 11 into a lower dead centre position and subsequent upwards movement into the position of rest.

Rapid Traverse Downwards

The control valves 39, 41 switch into position (B), the control valve 58 switches into position (A), whereby the connection 54 of the hydraulic pump 47 is connected to the pressure store 57. The electric motor 46 and thus the hydraulic pump 47 are set into rotation, the press beam 11 moves downwards. In a typical design about 90% of the volume displaced from the piston-side pressure chamber 23 is received by the piston-side pressure chamber 22. The corresponding oil flow flows via the bypass line 55 and the control valves 41. The oil flow conveyed by the hydraulic pump 47 into the pressure store 57 corresponds to the displaced relatively small rod volume relative to the ring side volume and therefore a very high rapid traverse speed is achieved.

Working Operation Downwards

The control valve 41 switches into position (A), whilst the control valve 58 switches to position (B), whereby the line 51 is connected to the pressure store 57. The hydraulic pump 47 conveys into the rod-side pressure chamber 22 and produces a large force via the ring surface of the pressure cylinder 12. The pressure applied by the pressure store 57 in the piston-side pressure chamber 23 holds the press beam 11 up even when no pressing forces act on the press beam 11.

Working Operation Upwards with Decompression Phase:

The control valves 39, 41 and the control valve 58 remain in the same position as in the case of working operation downwards. The electric motor 46 and the hydraulic pump 47 rotate in the other direction. The medium pressure in the pressure store 57 lifts the press beam 11 up, the motor speed controls the lifting speed, whereby a controlled decompression is possible, i.e. reduction of reaction forces by the restoring force of the workpiece, back-forming of the bending of the press beam 11 and the press frame 3 taking place during the shaping process, in particular of the side stands.

Rapid Traverse Upwards

The switching positions of the control valves 39, 41, 58 are the same as in the case of rapid traverse downwards but with a reversal of the conveying direction of the hydraulic pump 47. The hydraulic pump 47 presses upwards via the differential face equal to the piston rod area, the piston 24 and thereby the press beam 11.

Holding Up in a Position of Rest

The control valve 39 is in switching position (A), whereby the press beam is held by the medium pressure in pressure chamber 23.

Emergency Stop in Rapid Traverse Downwards:

By rapidly switching the control valve 39 into switching position (A) the piston-side pressure chamber 23 is locked, the press beam 11 comes quickly to a standstill.

Holding upwards in the position of rest and the emergency stop, controlled by the control valve 39, ensures an inexpensive solution when compared with mechanical braking, which acts on the electric motor 46 or the press beam 11, e.g. by the possibility of using an inexpensive asynchronous motor fed by a frequency converter as the electric motor 46.

Figure 3:
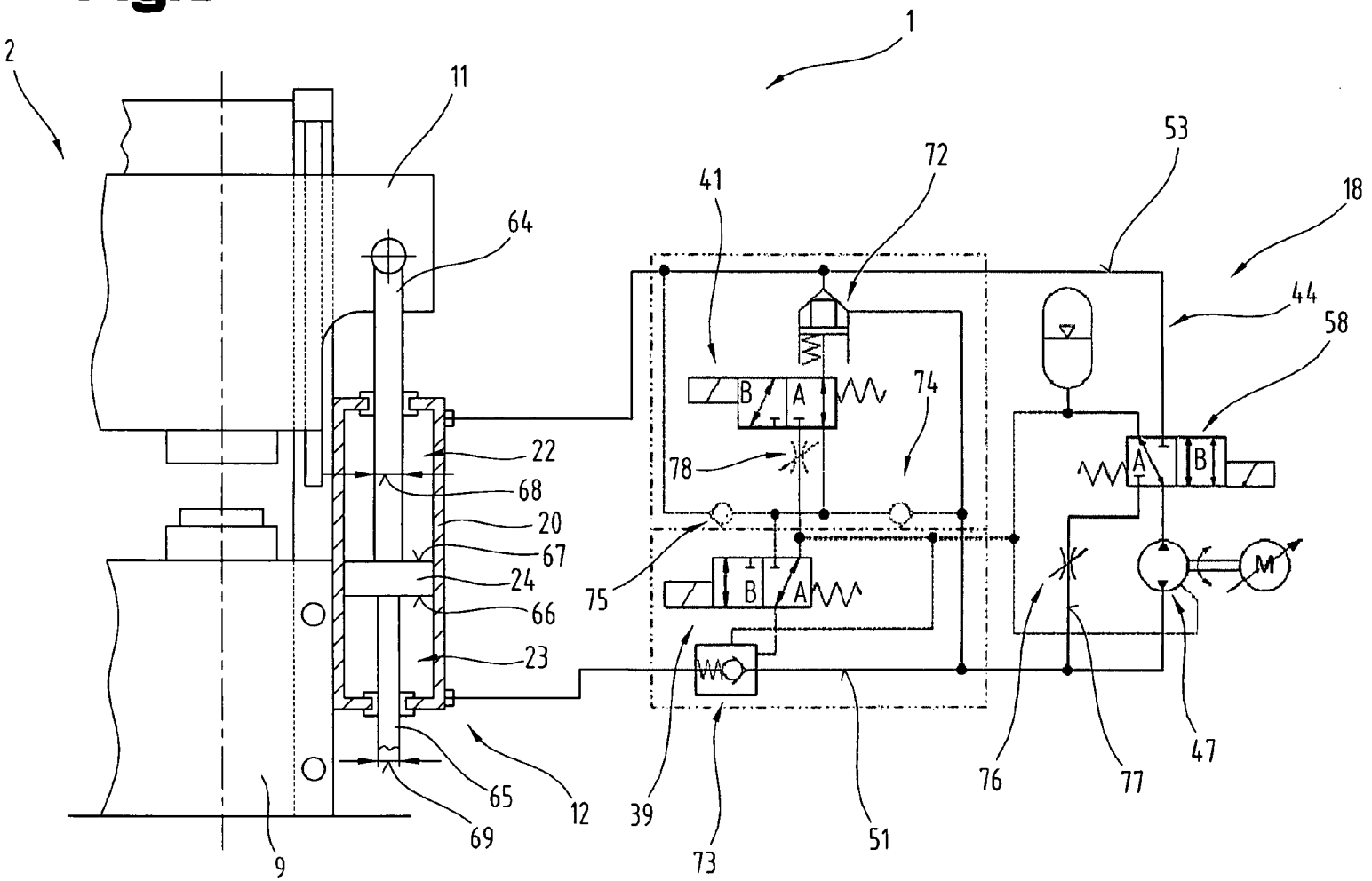
FIG. 3 shows a preferred development of the hydraulic drive device for the folding press according to the invention.

FIG. 3 shows a further embodiment of the hydraulic control device in a preferred variant of the pressure cylinder 12 as a differential cylinder 19 of the folding press 2 and the hydraulic system 18.

The pressure cylinder 12, in the shown exemplary embodiment, e.g. fixed relative to the press table 9, comprises a continuous piston rod 25 with a rod element 64 passing through the cylinder housing 20 upwards in the direction of the press beam 11 and a rod element 65 passing through the cylinder housing 20 in the direction of the contact surface 7. The press beam 11 is drive-connected to the rod element 64. The rod element 65 is designed for achieving a predetermined area ratio on the piston 24 of the ring surface 66 facing the pressure chamber 23 for the upwards movement of the press beam 11 and the pressing area 67 facing the pressure chamber 22 for working operation. The rod diameter 68 of rod element 64 is greater than the rod diameter 69 of rod element 65, whereby the ring surface 66 is greater the ring surface 67 and the area ratio according to a preferred embodiment is greater than 1 to less than 1.5. The use of the rod element 65 guided downwards ensures a preferred area ratio even with a larger rod diameter 68, to avoid too much bending loading by having a high inherent weight of the press beams 11 or high acceleration forces.

The hydraulic system 18 according to the preferred embodiment provides several control and regulating elements 70 and control lines 71 to the control valve 39 and control valve 41, as described in more detail below.

In rapid traverse mode relatively high volumes flow through the control valves 39, 41, which cause significant pressure losses at directly activated industrial switch valves of nominal size 6. In this way in rapid traverse mode downwards cavitation can occur in the upper pressure chamber 22. Therefore, preferably hydraulically servo-controlled valves are used which permit such volume flows with acceptable pressure losses. In the case of control valve 41 there is a servo-controlled cartridge-valve 72 and the case of control valve 39 a servo-controlled, unlockable non-return valve 73. If the servo-control step is redundant the functions intended for the control valve 39, emergency-stop-trigger and holding up, are secured redundantly.

With non-return valves 74, 75 the respectively greatest pressure is put on one of the control lines. The access to the storage pressure supplies the minimum pressure in the system. This switching variant ensures a) a reliable opening of the valves in the operating states;

b) a rapid emergency stop in rapid traverse downwards mode—that is the most critical case for reaching the required stopping path;

c) in order to switch the drive from the operating state rapid traverse downwards into the press configuration rapidly and without jerkiness and without stopping the pressure beam a throttle valve 76 is arranged in a line 77 leading from line section 51 to control valve 58—in this exemplary embodiment a 4/2-way valve and thus ensures a rapid and continuous transition between both operating states, without completely decelerating the pressure beam, which contributes to a reduction in the cycle times;

d) an additional throttle valve 78 during the servo-control stage to the control valve 41 allows a gentle transition without a rapid equalisation of pressure from the working operation to the rapid traverse mode and thus ensures a rapid and continuous transition between both operating positions, without completely decelerating the pressure beam. This contributes to a reduction in the cycle times.

Unlike the embodiment described in the preceding Figure in this case the control valve 41 is a 2/2-way valve and the control valve 58 a 4/2-way valve.

Figure 4:
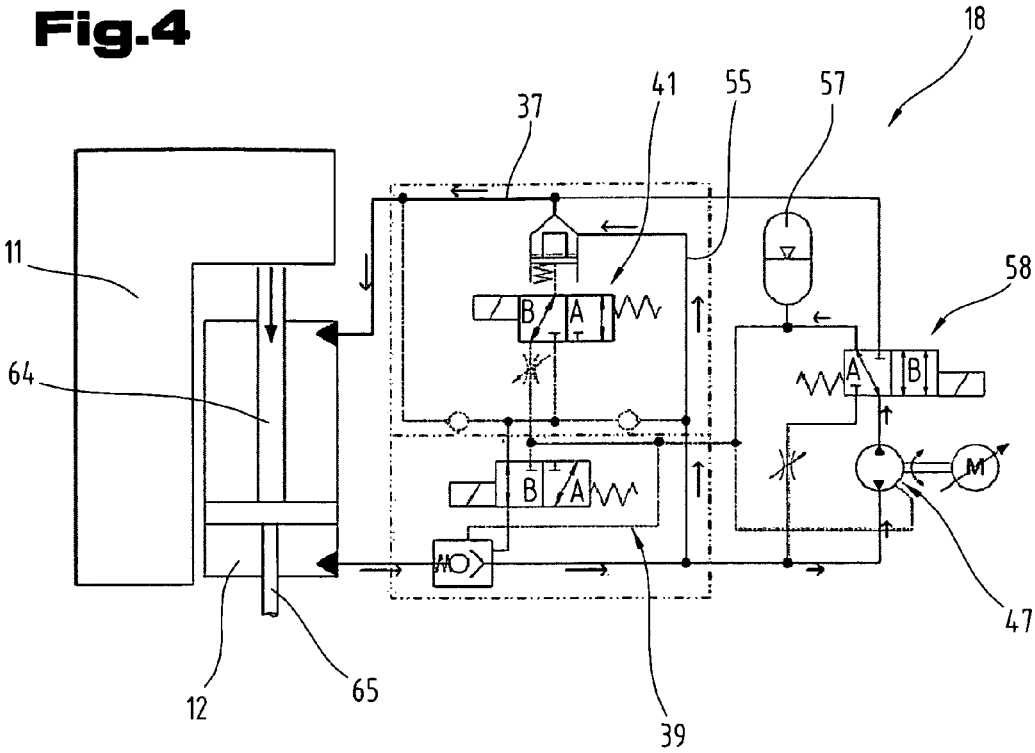
FIG. 4 shows a hydraulic scheme for the preferred development in a wiring scheme for the operating state "rapid traverse-downwards"

FIG. 4 shows the hydraulic system 18 already described above with its components in the switching position of the control valves 39, 41 and the control valve 58 for the operating position "rapid traverse downwards" of the press beam 11.

The hydraulic pump 47 conveys in this operating position the corresponding oil volume of the entering rod element 64 minus the volume of the exiting rod element 65, i.e. a differential volume via the control valve 58 into the pressure store 57. The remaining oil volume flows via the bypass line 55 and the pressure line 37 into the pressure chamber 22 of the pressure cylinder 12.

Figure 5:
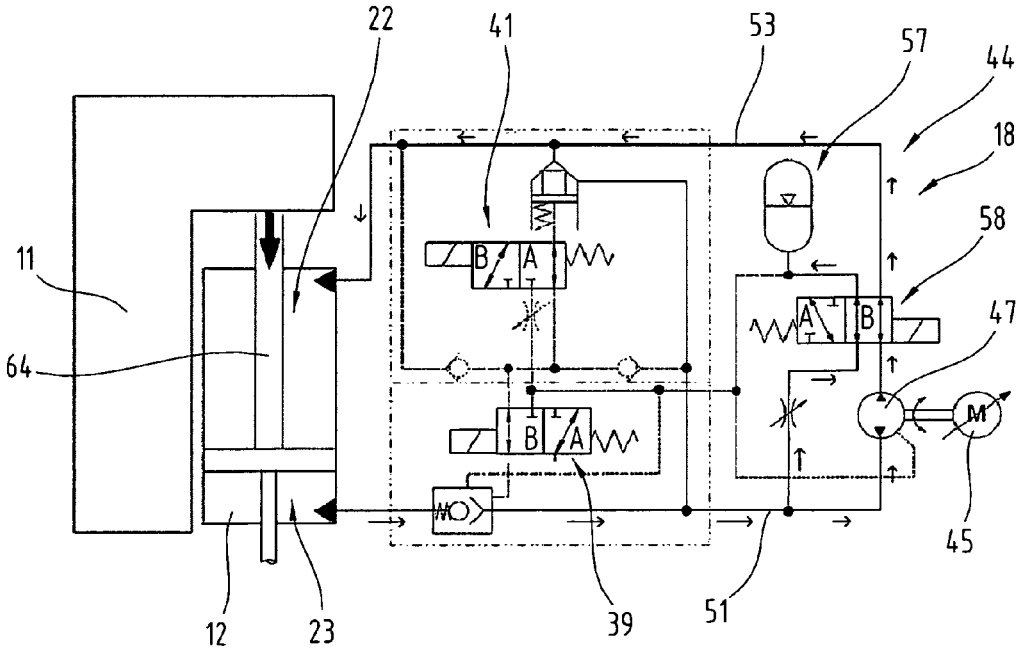
FIG. 5 shows the hydraulic scheme according to FIG. 4 in a wiring scheme for an operating state "working operation-downwards"

FIG. 5 shows the hydraulic system 18 with the control valves 39, 41 and the control valve 58 in the switching positions for the operating position "operating mode downwards" of the press beams 11.

To prevent jerky switching, if the pressure level in the pressure chamber 23 of the pressure cylinder 12 does not correspond exactly to the pressure level in the pressure store 57, the throttle valve 76 is provided in the line 77 leading from line section 51 bypassing the hydraulic pump 47 to the control valve 58.

During the working operation downwards by means of the hydraulic pump 47 a volume flow is conveyed from the pressure chamber 23 via the control valve 58 and the line section 53 of the ring line 44 into the pressure chamber 22 of the pressure cylinder 12. The remaining, displaced oil volume from the pressure chamber 23 is directed via the line 67 and the control valve 58 into the pressure store 57 and held by the latter.

Prior to switching the movement of the press beam 11 into the operating sequence "rapid traverse mode upwards" a decompression phase is performed, in which a controlled relaxation of the deformations of the press beam 11 and the press frame caused by the pressing force, in particular of the side stands, as well as a reduction in the restoring force of the workpiece is introduced, whereby in this decompression phase the switching of the control valves 39, 41 and the control valve 58 is the same as in the operating mode "operating mode downwards" but with a reversal of the rotational direction of the drive motor 45 and the hydraulic pump 47, in which the conveying flow of the hydraulic pump 47 is reversed relative to the conveying direction for the "working operation downwards".

Figure 6:
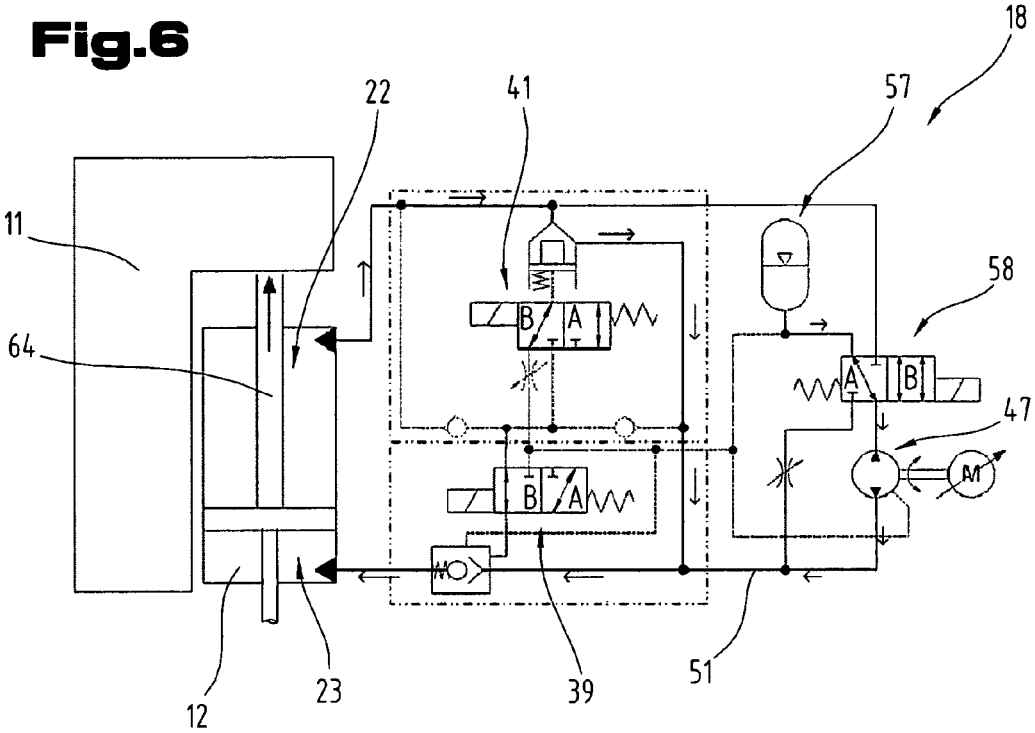
FIG. 6 shows the hydraulic scheme according to FIG. 4 in a wiring scheme for an operating state "rapid traverse-upwards"

FIG. 6 shows the hydraulic system 18 with the switching positions of the control valves 39, 41 and the control valve 58 in operating position "rapid traverse upwards" of the pressure beam 11.

The hydraulic pump 47 conveys in this operating position the oil volume corresponding to the exiting rod element 64 from the pressure store 57 via the line section 51 into the pressure chamber 23 of the pressure cylinder 12. The oil volume displaced from the pressure chamber 22 via the control valves 41 and 39 located in this switching position is fed directly to the pressure chamber 23, wherein the oil volume conveyed by the hydraulic pump 47 is relatively small.

Figure 7:
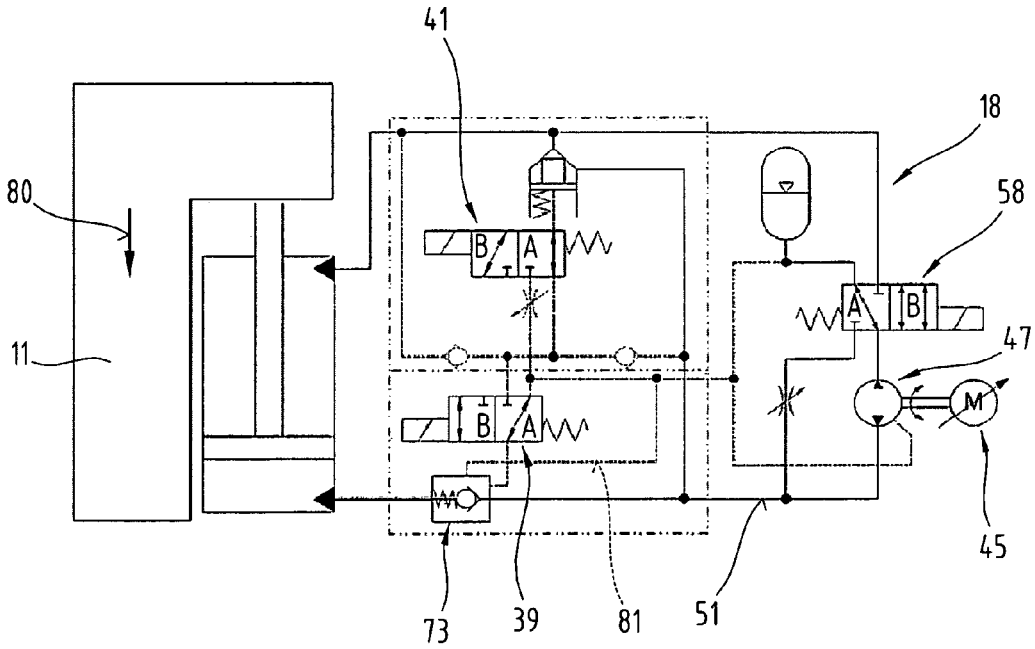
FIG. 7 shows the hydraulic scheme according to FIG. 4 in a wiring scheme for an operating state "emergency stop from rapid traverse-downwards".

FIG. 7 shows the hydraulic system 18 for the operating mode "emergency stop" of the press beam 11 during a rapid traverse movement upwards—according to arrow 80—with the corresponding switching positions of the control valves 39, 41 and control valve 58. In an emergency stop the hydraulically unlockable non-return valve 73 in the line section 51 is driven and closed by switching the control valve 39 of a control line 81 by the storage pressure. Parallel to this the drive motor 45 and thus the hydraulic pump 47 are stopped. At the same time the control valves 39, 41 and the control valve 58 are switched into position (A), whereby a stopping path corresponding to the safety guidelines and the resulting requirements is achieved in the downwards movement—according to arrow 80—of the press beam 11.

Figure 8:
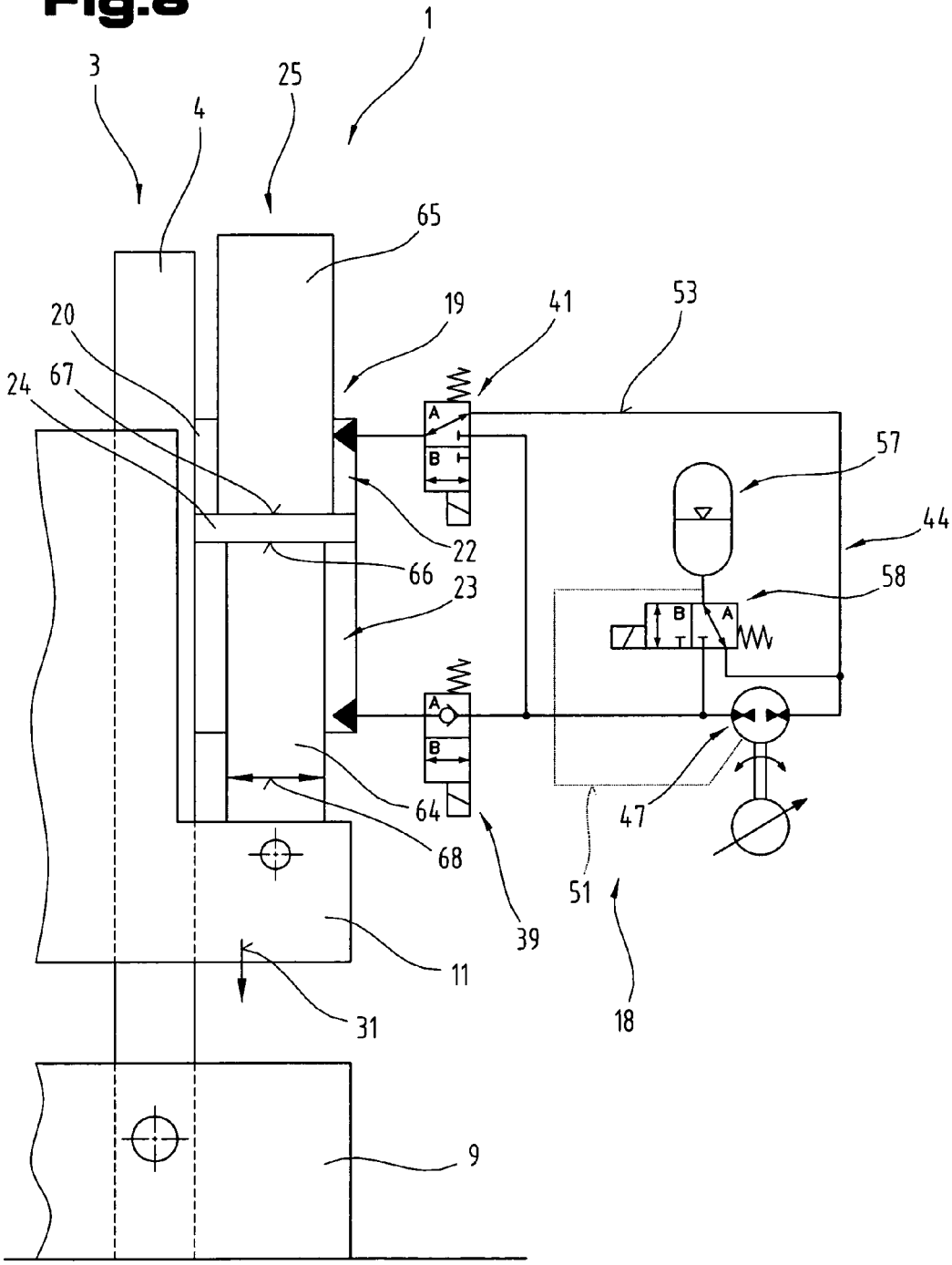
FIG. 8 shows a different embodiment of the drive device according to the invention with a pressure cylinder secured onto the press frame and a simplified hydraulic system.
Figure 9:
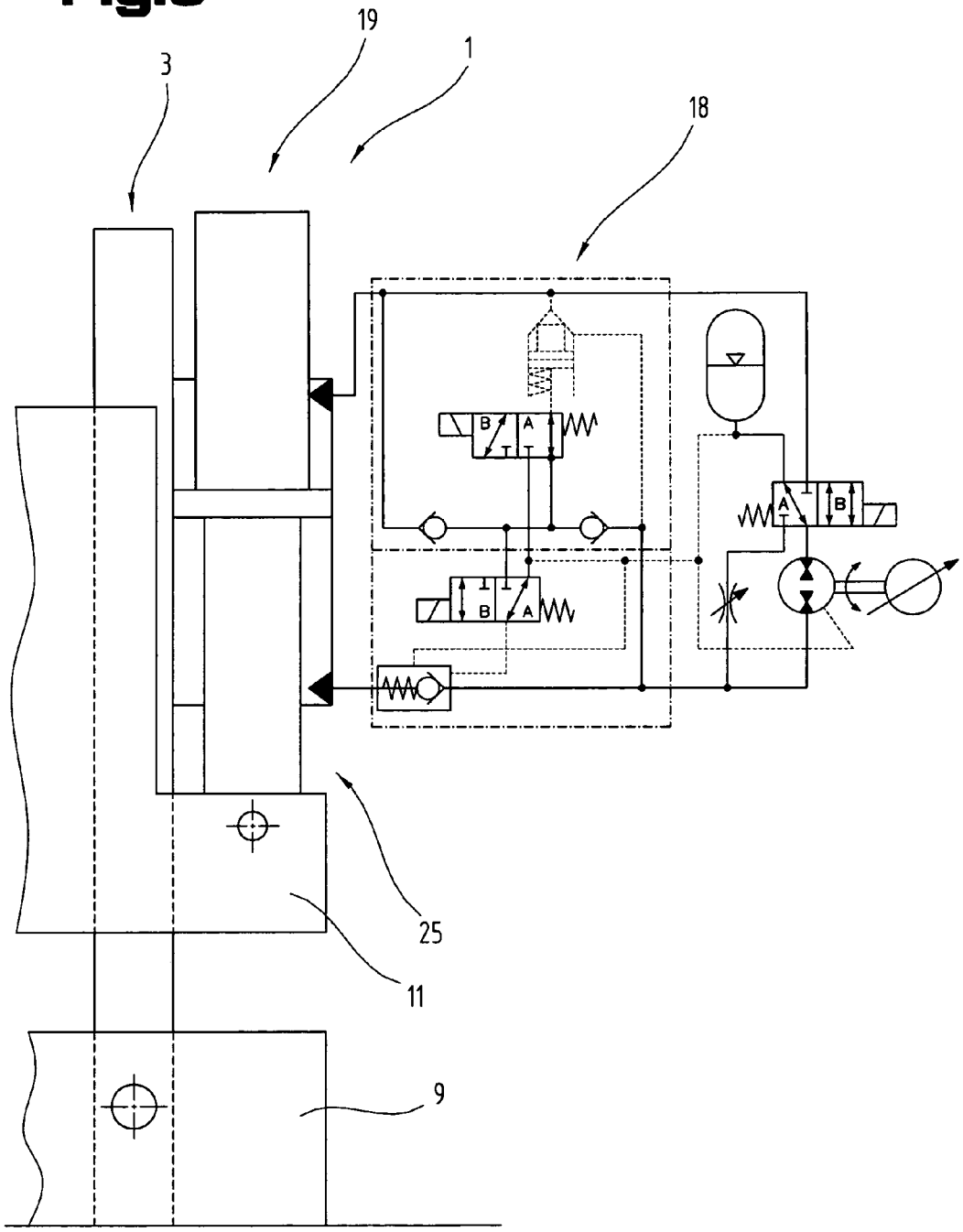
FIG. 9 shows the embodiment according to FIG. 8 with an extended hydraulic system.

FIGS. 8 and 9 show another embodiment of the drive device 1 for the press beam 11 adjustable relative to the fixed press table 9, with differently designed hydraulic systems 18, as already described in detail in FIGS. 2 and 3.

According to this embodiment the differential cylinder 19 is secured in a fixed manner to the press frame 3, in particular to the cylinder housing 20 on side support 4, and the latter comprises the continuous piston rod 25, which is formed from the rod elements 64, 65 provided with different diameters.

The arrangement is selected such that by means of the piston rod 25 on the adjustable press beam 11 during a displacement of the press beam 11 in the direction of the press table 9—according to arrow 31—a pressing force or a support force dependent on the inherent weight of the press beam 11 is exerted. The rod element 64 having the smaller rod diameter 68 is coupled to the press beam 11 in the rod bearing 17.

By means of the different ring surfaces 66, 67 of the piston 24 assigned to the pressure chambers 22, 23 by means of the hydraulic systems 18 shown by way of example, the already mentioned advantages of optimising the movement sequences of the press beam 11 are achieved for the respective operating positions in connection with the closed hydraulic system 18, the controllable and conveying direction reversible hydraulic pump 47 and pressure store 57 and the ring line 44 formed from the line sections 51, 53.

The switching of the control valves 39, 41, 58 is shown for the operating state "standstill of the press beam 11" as provided on the one hand for holding the press beam 11 in an upper dead centre position or an intermediate position, e.g. a rapid stop.

Figure 10:
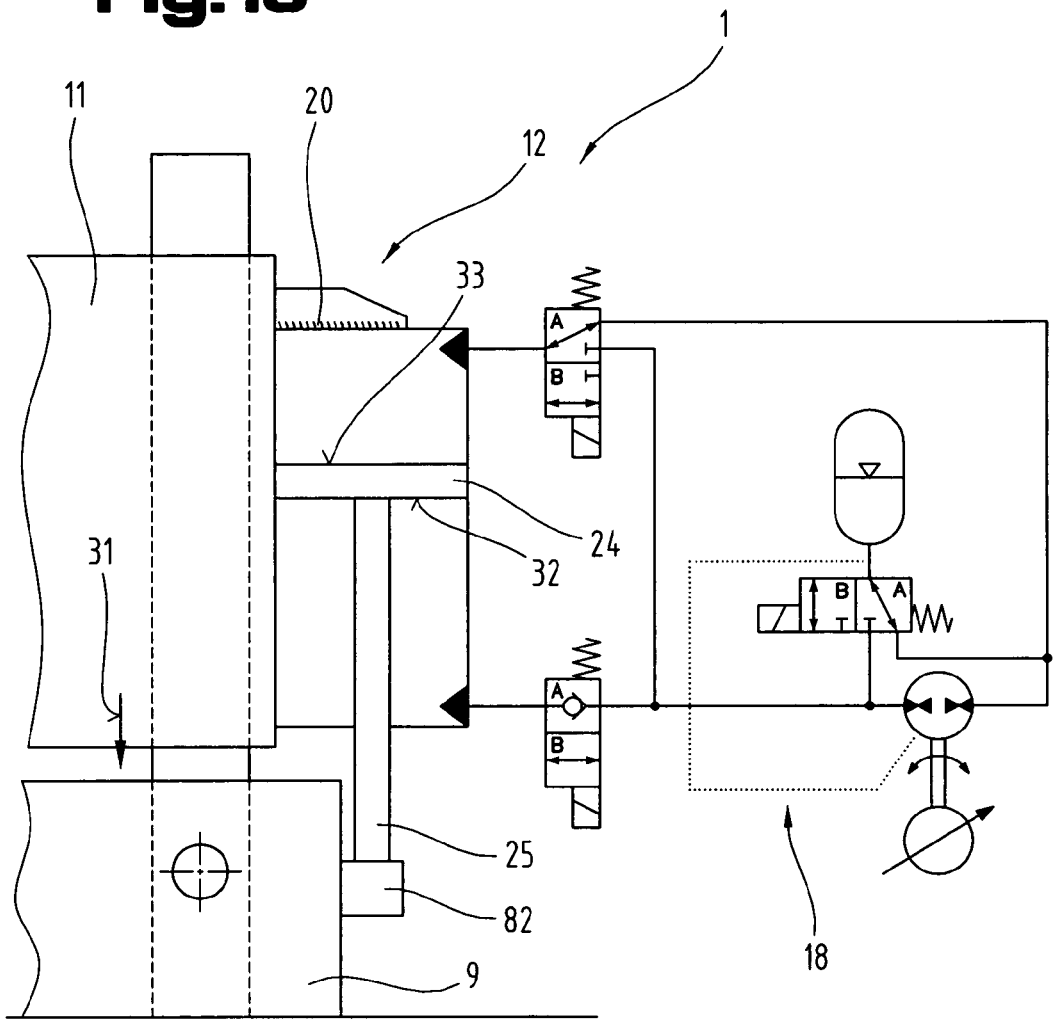
FIG. 10 shows a further embodiment of the drive device with a pressure cylinder secured onto the adjustable press beam and with a simplified hydraulic system.
Figure 11:
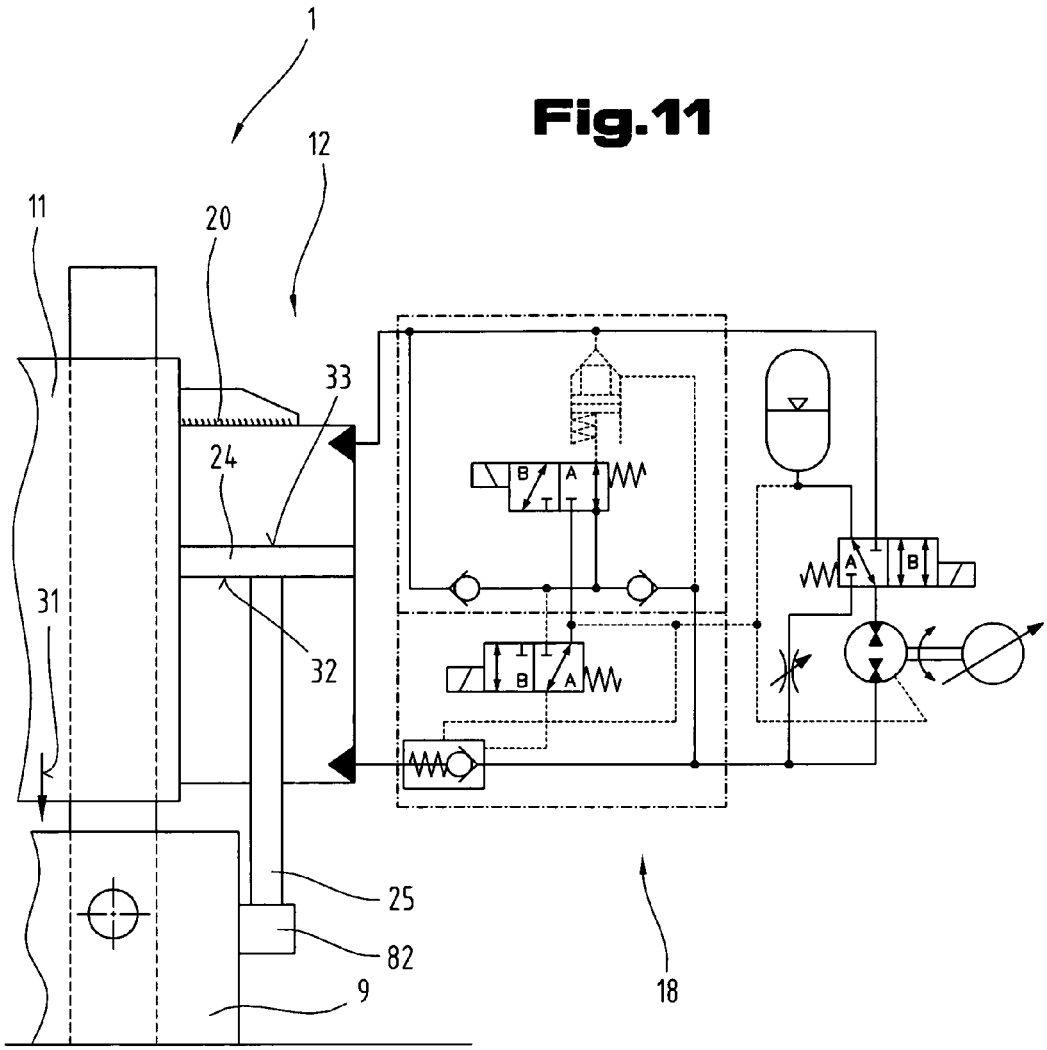
FIG. 11 shows the design according to FIG. 10 with an extended hydraulic system.

FIGS. 10 and 11 show another arrangement of the pressure cylinder 12 of the drive device 1 and the previously described differently designed hydraulic system 18, which is therefore not discussed any further in detail.

The pressure cylinder 12 comprises in this exemplary embodiment the piston rod 25 projecting on one side and is connected securely e.g. with the housing 20 or housing bearing to the adjustable press beam 11.

The projecting piston rod 25 is coupled securely in an abutment 85 secured to the press table 9 or the press frame 3. In this way on a displacement of the press beam 11 in the direction of the press table 9—according to arrow 31—there is a tensile loading in the piston rod 25 or pressure loading by a force determined by the inherent weight of the press table 11 on holding the press table 11 in an upper dead centre position or intermediate position in addition to a force, as occurs on braking the press beam 11 in the case of an emergency stop, as described already in the preceding Figures.

The movement sequences are optimised in this arrangement of the pressure cylinder 12 like-wise by the different surface contents of the piston active face 33 according to the diameter of the piston 24 on the one hand and the piston ring surface 32 on the other hand.

The switching of the control valve is shown, as already described in the preceding figures, for the operating mode "standstill of the press beam".

Figure 12:
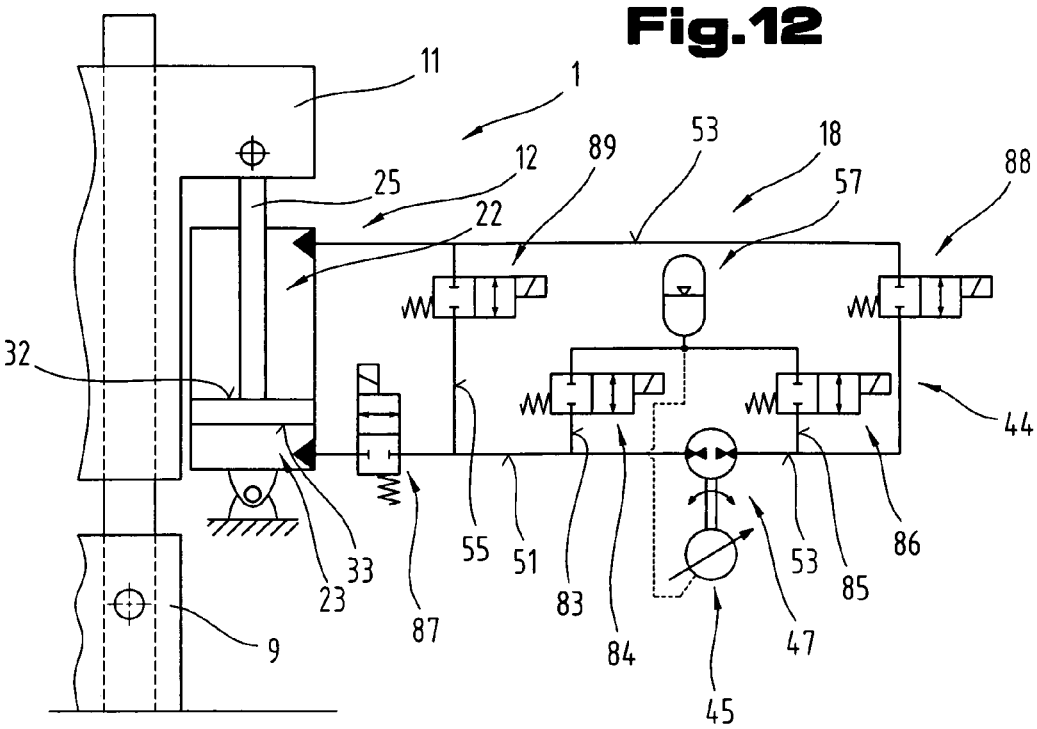
FIG. 12 shows the drive device with an additional embodiment of the hydraulic system with a wiring scheme for the operating state "standstill"
Figure 13:
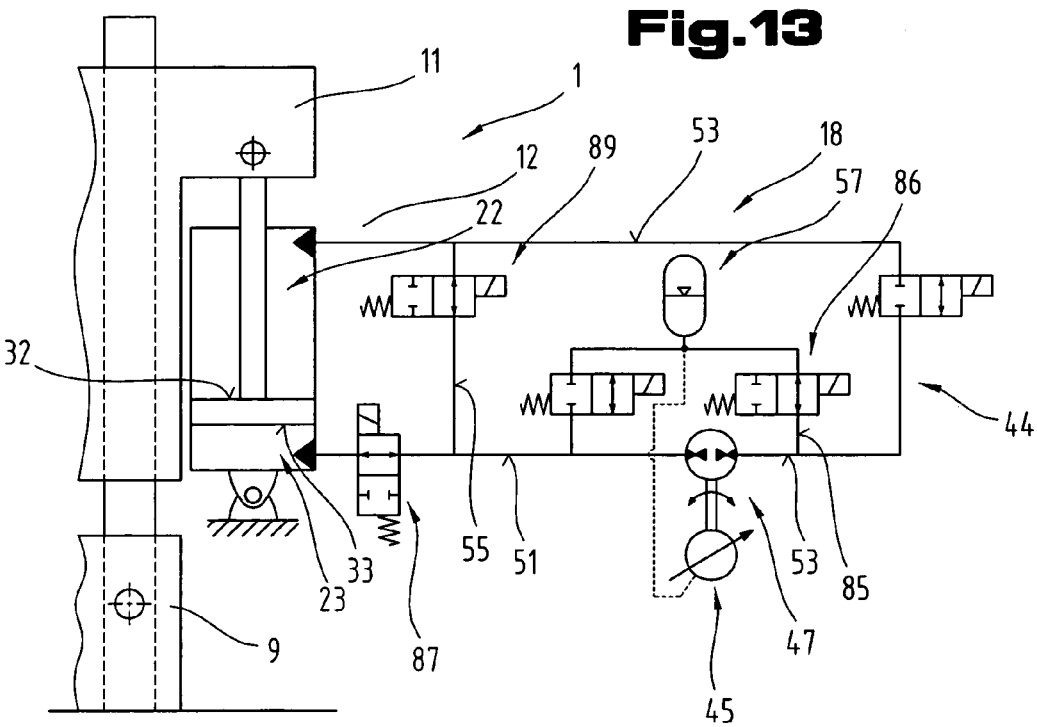
FIG. 13 shows the hydraulic system according to FIG. 12 with a wiring scheme for the operating state "rapid-upwards" and "rapid-downwards"
Figure 14:
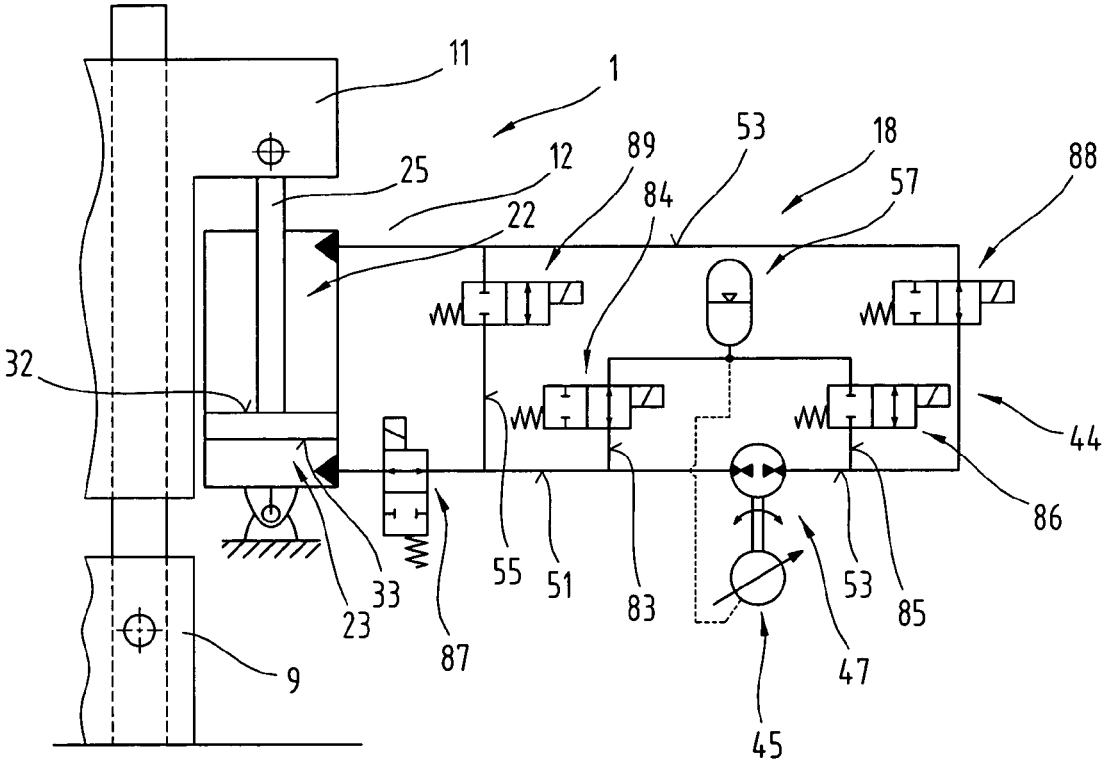
FIG. 14 shows the drive device with the hydraulic system according to FIG. 12 with a wiring scheme for the operating state "press".

FIGS. 12 to 14 show the drive device 1 with a further variant of the hydraulic system 18. The pressure cylinder 12 has a piston rod 25 projecting on one side. In the shown arrangement there is a tensile load in the piston rod 25 during a pressing procedure.

The hydraulic system 18 comprises the ring line 44 with the line sections 51, 53. The line section 51 connects the hydraulic pump 47 with the pressure chamber 23 for charging the piston active face 33. The line section 53 connects the hydraulic pump 47 to the pressure chamber 22 with the piston ring surface 32.

The pressure store 57 is activated or deactivated optionally via a line 83 and a control valve 84 with the line section 51, or via a line 85 and a control valve 86 with the line section 53, and switching positions of the control valve 84 according to the respective operating state.

A control valve 87, 88 is arranged respectively in the line sections 51, 53. In the bypass line 55, which connects line section 51 to the line section 53 a further control valve 89 is arranged.

The hydraulic pump is set up as already described in the preceding examples for conveying in reversible direction and is operated by the speed-controllable drive motor 45.

2/2-way valves are provided as control valves 84, 86, 87, 88, 89 according to this variant of the hydraulic system 18.

FIG. 12 shows the switching positions for the operating state "standstill" or "emergency stop", in which all of the control valves 84, 86, 87, 88, 89 are switched into a locked position and the hydraulic pump 47 is switched off.

FIG. 13 shows the switching positions for the operating states "rapid traverse-downwards" and "rapid traverse upwards". In this operating state the pressure chambers 22, 23 of the pressure cylinder 12 are connected via the bypass line 55 and the control valves 87, 89 switched to throughput, by means of which a low volume flow, which corresponds to the differential volume of the pressure chambers 22, 23, is conveyed from the control valve 86 and line 85 also switched to the throughput depending on the direction of movement of the press beam 11 into the pressure store 57 or fed out of the latter into the ring line 44.

This allows as already described for the preceding figures, an energy-efficient design of the hydraulic pump 47 or the drive motor 45 and also the lines and control valves.

FIG. 14 shows the switching positions of the control valves for the direct operating position "pressing operation", in which the shaping force of the press beam 11 in an adjusting movement in the direction of the press table 9—according to arrow 31—has to be applied for shaping a workpiece not shown in more detail. For this operating state the control valve 87 of the line section 51 and the control valve 88 of the line section 53 is switched to throughput and thus there is a direct flow connection between the pressure chambers 23, 22.

At the same time there is a flow connection of the line section 51 via the line 83 and the control valve 84 connected for throughput for subsequently storing the excess volume of the mediums, owing to the differences in volume of the pressure chambers 22, 23 in the pressure store 57 caused by the one side piston rod 25.

The bypass line 55 with the control valve 89 is locked in this operating position, as well as the line 85 between the line section 53 and the pressure store 57 by the locking position of control valve 86.

The exemplary embodiments show possible embodiment variants of the drive device, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the drive device the latter and its components have not been represented true to scale in part and/or have been enlarged and/or reduced in size.

The problem addressed by the independent solutions according to the invention can be taken from the description.

List of Reference Numerals

| | |
|---|---|
| 1 | drive device |
| 2 | folding press |
| 3 | press frame |

-continued

| List of Reference Numerals | |
|---|---|
| 4 | side support |
| 5 | side support |
| 6 | cross connection |
| 7 | contact surface |
| 8 | plane |
| 9 | press table |
| 10 | linear guide |
| 11 | press beam |
| 12 | pressure cylinder |
| 13 | drive device |
| 14 | double arrow |
| 15 | bending tool |
| 16 | housing bearing |
| 17 | rod bearing |
| 18 | hydraulic system |
| 19 | differential cylinder |
| 20 | cylinder housing |
| 21 | cylinder chamber |
| 22 | pressure chamber |
| 23 | pressure chamber |
| 24 | Piston |
| 25 | piston rod |
| 26 | end section |
| 27 | bolt |
| 28 | side face |
| 29 | rod lead-through |
| 30 | end flange |
| 31 | arrow |
| 32 | piston ring surface |
| 33 | piston active face |
| 34 | internal diameter |
| 35 | piston rod diameter |
| 36 | pressure line |
| 37 | pressure line |
| 38 | connection |
| 39 | control valves |
| 40 | connection |
| 41 | control valve |
| 42 | connection |
| 43 | connection |
| 44 | ring line |
| 45 | drive motor |
| 46 | electric motor |
| 47 | hydraulic pump |
| 48 | arrow |
| 49 | arrow |
| 50 | double arrow |
| 51 | line section |
| 52 | connection |
| 53 | line section |
| 54 | connection |
| 55 | bypass line |
| 56 | connection |
| 57 | pressure store |
| 58 | control valve |
| 59 | connection |
| 60 | line |
| 61 | connection |
| 62 | line |
| 63 | connection |
| 64 | rod element |
| 65 | rod element |
| 66 | ring surface |
| 67 | ring surface |
| 68 | rod diameter |
| 69 | rod diameter |
| 70 | control and regulating element |
| 71 | control line |
| 72 | cartridge - valve |
| 73 | non-return valve |
| 74 | non-return valve |
| 75 | non-return valve |
| 76 | throttle valve |
| 77 | line |
| 78 | throttle valve |
| 79 | |
| 80 | arrow |

-continued

| List of Reference Numerals | |
|---|---|
| 81 | control line |
| 82 | abutment |
| 83 | line |
| 84 | control valve |
| 85 | line |
| 86 | control valve |
| 87 | control valve |
| 88 | control valve |
| 89 | control valve |

The invention claimed is:

1. A drive device for a bending press, the drive device comprising a press frame, a press table, and a press beam which is adjustable relative to the press table via a hydraulic system comprising a hydraulic pump with a controllable drive motor, a switching and control device and pressure lines and a pressure store with pressure cylinders chargeable by a pressure medium, and the hydraulic system with a ring line comprising the hydraulic pump forms a switchable flow circuit closed by control valves for the pressure medium with a first line section of the ring line between a pressure chamber of at least one pressure cylinder and the hydraulic pump and with a second line section of the ring line between an additional pressure chamber of the pressure cylinder and the hydraulic pump and the pressure store is flow connected via at least one of the control valves optionally with the first line section or the second line section of the ring line for holding or releasing a stored volume of the pressure medium, the at least one pressure cylinder comprising a piston separating a cylinder chamber into the pressure chambers, the piston including a first piston active surface for applying a pressing force onto the press beam and a second piston active surface opposite to the first piston active surface, wherein the first piston active surface is smaller than the second piston active surface and a surface ratio of the first and second piston active surfaces is greater than 1 to less than 1.5.

2. The drive device according to claim 1, wherein the pressure store is connected via a line and the control valve with the line section of the ring line and a line and the control valve with the line section of the ring line.

3. The drive device according to claim 1, wherein the pressure cylinder is designed to have a piston rod projecting on one side.

4. The drive device according to claim 3, wherein a cross sectional area of the piston rod is about ⅕ to 1/20 of the first piston active surface surrounding the piston rod.

5. The drive device according to claim 1, wherein the pressure cylinder is formed by rod elements projecting on both sides.

6. The drive device according to claim 5, wherein diameters of the rod elements are different, whereby the diameter of the rod element drive-connected to the press beam to be displaced is greater than the diameter of the additional rod element.

7. The drive device according to claim 5, wherein diameters of the rod elements are different, whereby the diameter of the rod element drive-connected to the adjustable press beam is smaller than the diameter of the additional rod element.

8. The drive device according to claim 1, wherein the line sections are flow-connected directly and/or via a bypass line via suitable hydraulic valve combinations to the pressure chambers of the pressure cylinder.

9. The drive device according to claim 8, wherein a servo-controlled cartridge-valve is arranged in the bypass line.

10. The drive device according to claim 1, wherein the hydraulic pump and the drive motor of the hydraulic pump are designed for conveying the pressure medium in two directions.

11. The drive device according to claim 10, wherein the drive motor for the hydraulic pump is formed by an electric motor.

12. The drive device according to claim 11, wherein the electric motor is supplied with power via a speed control member.

13. The drive device according to claim 1, wherein an energy store is formed by a low pressure store.

14. The drive device according to claim 3, wherein on an adjustment of the press beam to apply a shaping force onto the workpiece a pressing force is exerted on the piston rod.

15. The drive device according to claim 3, wherein upon an adjustment of the press beams to apply a shaping force onto the workpiece a tensile force is exerted on the piston rod.

16. The drive device according to claim 3, wherein the piston rod is connected via a rod bearing to the adjustable press beam.

17. The drive device according to claim 3, wherein the piston rod is connected via an abutment to the press frame or the press table.

18. The drive device according to claim 11, wherein the pressure cylinder is secured via a housing bearing onto the press frame.

19. The drive device according to claim 11, wherein the pressure cylinder is secured via a housing bearing onto the press beam.

* * * * *